US008925987B1

(12) United States Patent
Cody

(10) Patent No.: US 8,925,987 B1
(45) Date of Patent: Jan. 6, 2015

(54) RING LIFT DEVICE

(71) Applicant: Steve Cody, Coalgate, OK (US)

(72) Inventor: Steve Cody, Coalgate, OK (US)

( * ) Notice: Subject to any disclaimer, the term of this patent is extended or adjusted under 35 U.S.C. 154(b) by 0 days.

(21) Appl. No.: 13/999,719

(22) Filed: Mar. 18, 2014

(51) Int. Cl.
*B66C 1/42* (2006.01)
*B66C 1/44* (2006.01)

(52) U.S. Cl.
CPC ..... *B66C 1/44* (2013.01)
USPC ..... 294/207; 294/67.33

(58) Field of Classification Search
USPC ..... 294/67.33, 81.54, 81.62, 119.1, 207; 414/910
See application file for complete search history.

(56) References Cited

U.S. PATENT DOCUMENTS

| | | | | | |
|---|---|---|---|---|---|
| 597,438 | A | | 1/1898 | Schilling | |
| 1,969,873 | A | | 8/1934 | Bradford | |
| 3,002,779 | A | * | 10/1961 | Frate et al. | 294/67.33 |
| 3,076,673 | A | * | 2/1963 | Kaplan et al. | 294/67.33 |
| 3,655,232 | A | | 4/1972 | Martelee | |
| 3,999,665 | A | | 12/1976 | Rogers | |
| 4,051,966 | A | * | 10/1977 | Cotton | 414/428 |
| 4,358,143 | A | | 11/1982 | Cullen | |
| 4,368,913 | A | | 1/1983 | Brockmann | |
| 4,494,291 | A | | 1/1985 | Morrison | |
| 4,563,031 | A | * | 1/1986 | Kishimoto et al. | 294/81.21 |
| 4,600,354 | A | * | 7/1986 | Niewald et al. | 414/607 |
| 4,641,876 | A | | 2/1987 | Kiser | |
| 4,709,953 | A | | 12/1987 | Sirota | |
| 5,205,599 | A | | 4/1993 | Wassmer | |
| 5,895,198 | A | | 4/1999 | Lofstrom | |
| 5,997,064 | A | * | 12/1999 | Orita | 294/119.1 |
| 6,039,375 | A | * | 3/2000 | Bauman | 294/119.1 |
| 6,325,434 | B1 | | 12/2001 | Takao | |
| 6,558,108 | B1 | | 5/2003 | Van Oord | |

* cited by examiner

*Primary Examiner* — Dean Kramer
(74) *Attorney, Agent, or Firm* — Randal Homburg

(57) ABSTRACT

An overhead lift apparatus defines a frame having tracked lateral clamp arms defining three rotatable and spreadable wheels on opposing ends of the frame activated by a hydraulic spreading and retracting apparatus, the lateral clamp arms clamp onto an inner surface of an upper portion of a welded ring lifting the ring for transfer from one location to another without deformation of the ring, including additional outriggers with additional wheels to expand the diameter size for larger rings, and larger cylindrical vessels.

7 Claims, 7 Drawing Sheets

RING LIFT DEVICE

I. BACKGROUND OF THE INVENTION

1. Field of Invention

An overhead lift apparatus defines a frame having tracked lateral clamp arms defining three rotatable and spreadable wheels on opposing ends of the frame activated by a hydraulic spreading and retracting means, the lateral clamp arms clamp onto an inner surface of an upper portion of a welded ring lifting the ring for transfer from one location to another without deformation of the ring, including additional outriggers with additional wheels to expand the diameter size for larger rings, and larger cylindrical vessels.

2. Description of Prior Art

A preliminary review of prior art patents was conducted by the applicant which reveal prior art patents in a similar field or having similar use. However, the prior art inventions do not disclose the same or similar elements as the present ring clamp device, nor do they present the material components in a manner contemplated or anticipated in the prior art.

There were two types of devices that were functionally suited for the lifting or movement of a cylindrical object, primarily coils of materials. These devices included clamping mechanisms that either engage a coil or cylinder from one side or engage a coil from opposite ends, the coil being handled by the device not being the type that experiences any significant deformity when lifted or where deformation does not cause any significant concern.

The type of clamps which engage a coil or roll from both sides are incorporated within or defined by U.S. Pat. No. 6,558,108 to Van Oord, which includes a lifting mechanism for large roll on a horizontal axis, U.S. Pat. No. 6,325,434 to Takao, which is a scissor clamp for lifting a cylindrical object, U.S. Pat. No. 5,205,599 to Wassmer, defining a non-deforming margin roller lift, U.S. Pat. No. 4,709,953 to Sirota, which discloses an over lift mechanism for a spooled material, U.S. Pat. No. 4,641,876 to Kiser, which is identical to Wassmer, U.S. Pat. No. 4,368,913 to Brockman, and U.S. Pat. No. 1,969,873 to Bradford. In U.S. Pat. No. 3,655,232 to Martelee, a clamp device is disclosed with outer arms being expanded and contracted along a guided track in a central frame using a hydraulic piston to expand and contract the distance between the outer arms, the arms guided on a horizontal plane within the tracks of the frame.

Single arm lifts are disclosed in U.S. Pat. Nos. 597,438 to Schilling, which appears to be a balanced C-shaped object that grabs an inner diameter of a pipe, but does not express any concern over deformity of the object, and U.S. Pat. No. 3,999,665 to Rogers, which discloses a single transfer bar which carries a coiled material. Other patents disclose lift devices that engage some or all of an inner diameter of a cylindrical object, including U.S. Pat. No. 4,358,143 to Cullen, and U.S. Pat. No. 5,895,198 to Lofstrom, with Lofstrom expressing some concern over maintaining the curvature of a cylindrical or partially cylindrical object during lift and carry.

II. SUMMARY OF THE INVENTION

During the construction of certain industrial products, including cylindrical vessels, curved or cylindrical rings are used to construct a large cylindrical vessel or container during fabrication of components. Rolled metal panels are formed into rings, with the rings being stacked to construct the vessel. The rings are manufactured by a cold rolled press from longs sheets of metal and welded at a seam to form a circular ring. These rings, during the initial phase of construction after being tack welded along its common margin, are deformable, lacking full circular stability when carried on a horizontal axis or on its side. The deformation of the circular ring can cause either permanent disfigurement of the circular ring or can break the tack weld holding the margins together. It does not appear from the prior art that the prevention of disfigurement to a circular metal ring has been addressed, nor does it appear that the combination of any prior art discloses a device which can lift and carry a circular ring and providing the device with concern for preserving the integrity of the circular nature of the ring during manufacture.

The primary objective of the ring lift device is to provide lifting of large metal rings from an interior surface of the ring with a capacity to conform to variable size and interior diameters greater than six feet, avoiding significant deformation of the large metal rings and preserving the intended shape of the large metal ring during the transfer point movements involved in manufacturing of a cylindrical product or vessel. A secondary objective is to provide the device in an embodiment which is suspended from an overhead moveable means to lift the large metal ring vertically during the pressing, manufacturing and construction process.

III. DESCRIPTION OF THE DRAWINGS

The following drawings are submitted with this utility patent application.

IV. DESCRIPTION OF THE PREFERRED EMBODIMENT

Figure 1:
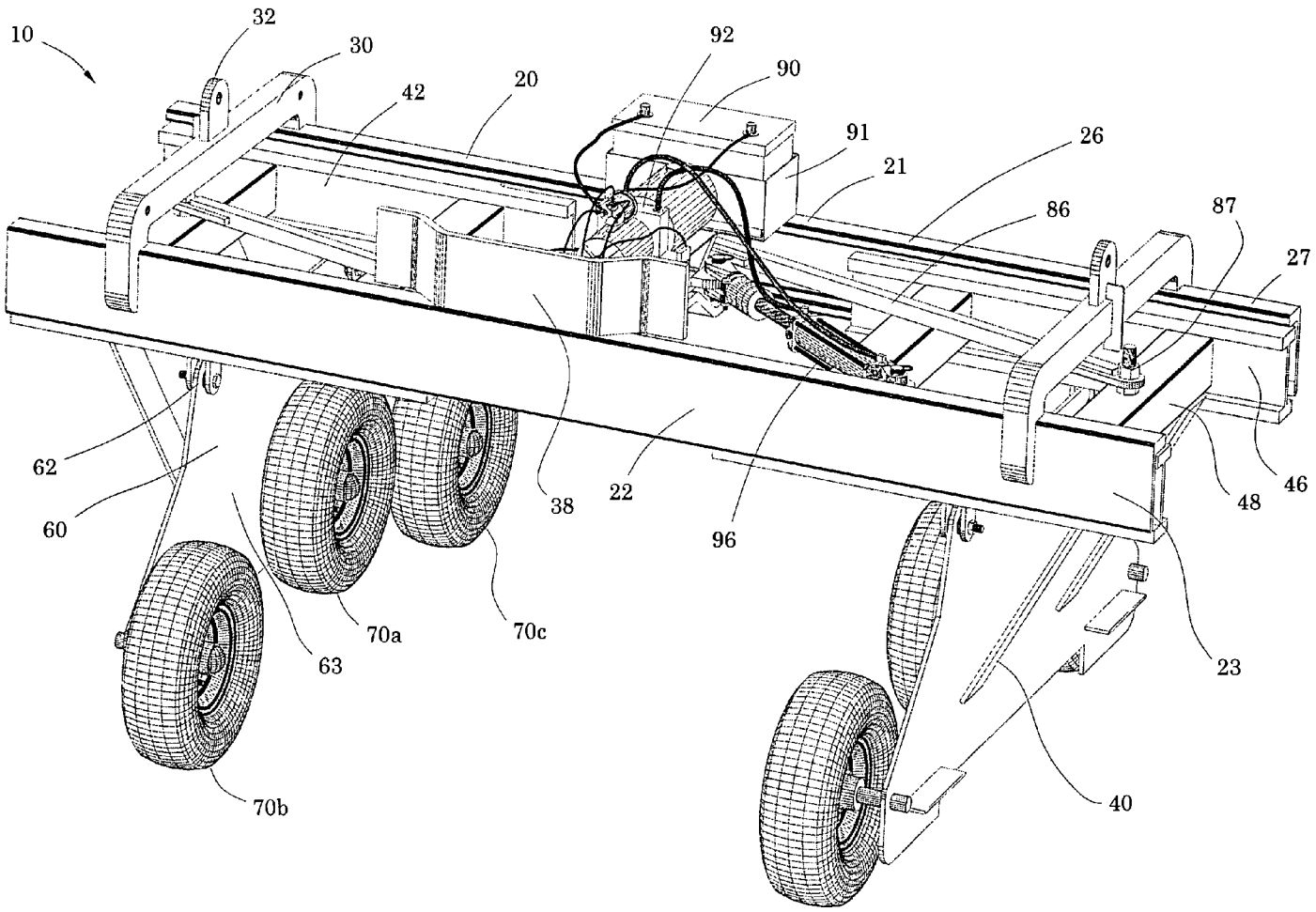
FIG. 1 is a top perspective view of a ring lift device.
Figure 2:
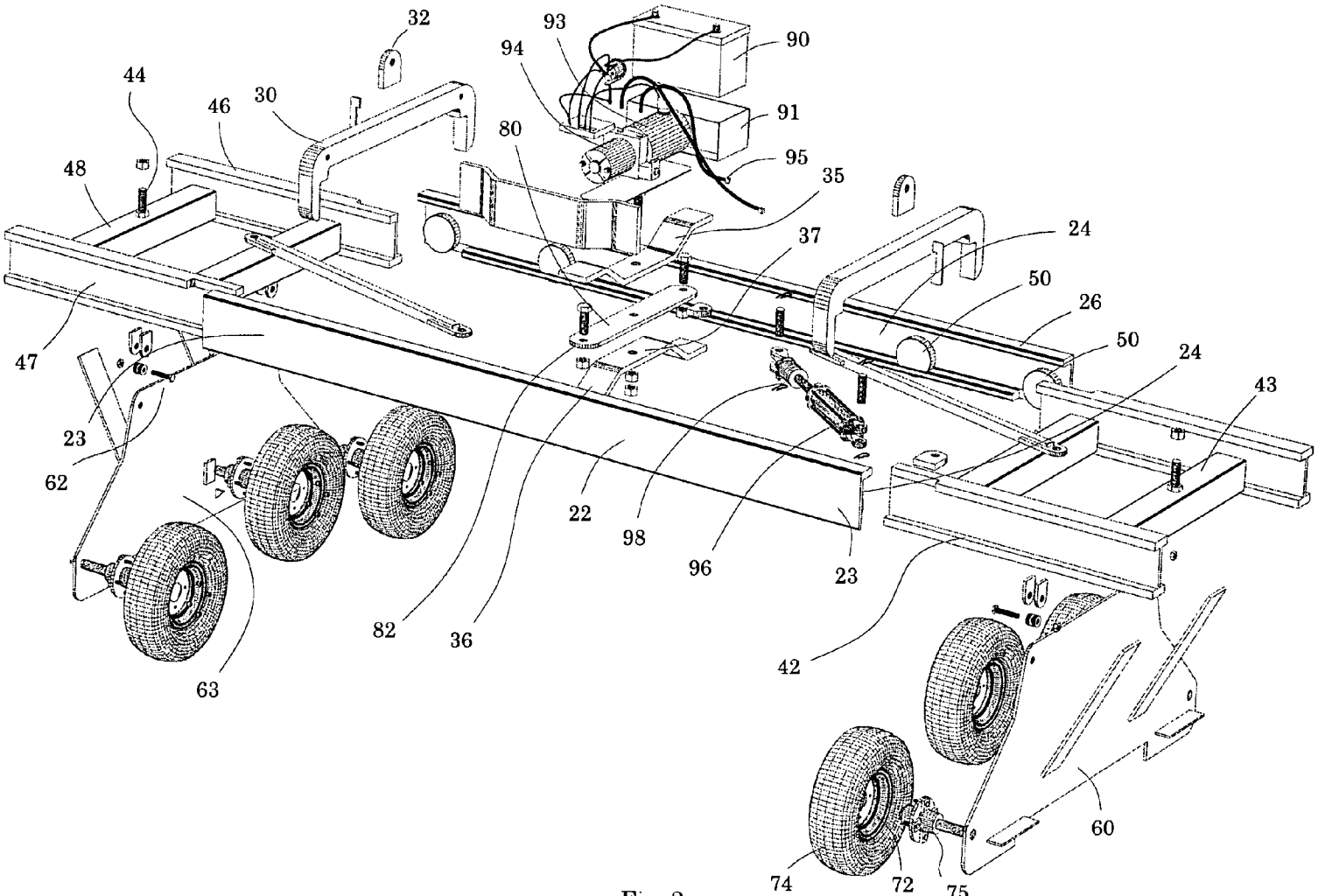
FIG. 2 is an exploded components view of the ring lift device.
Figure 3:
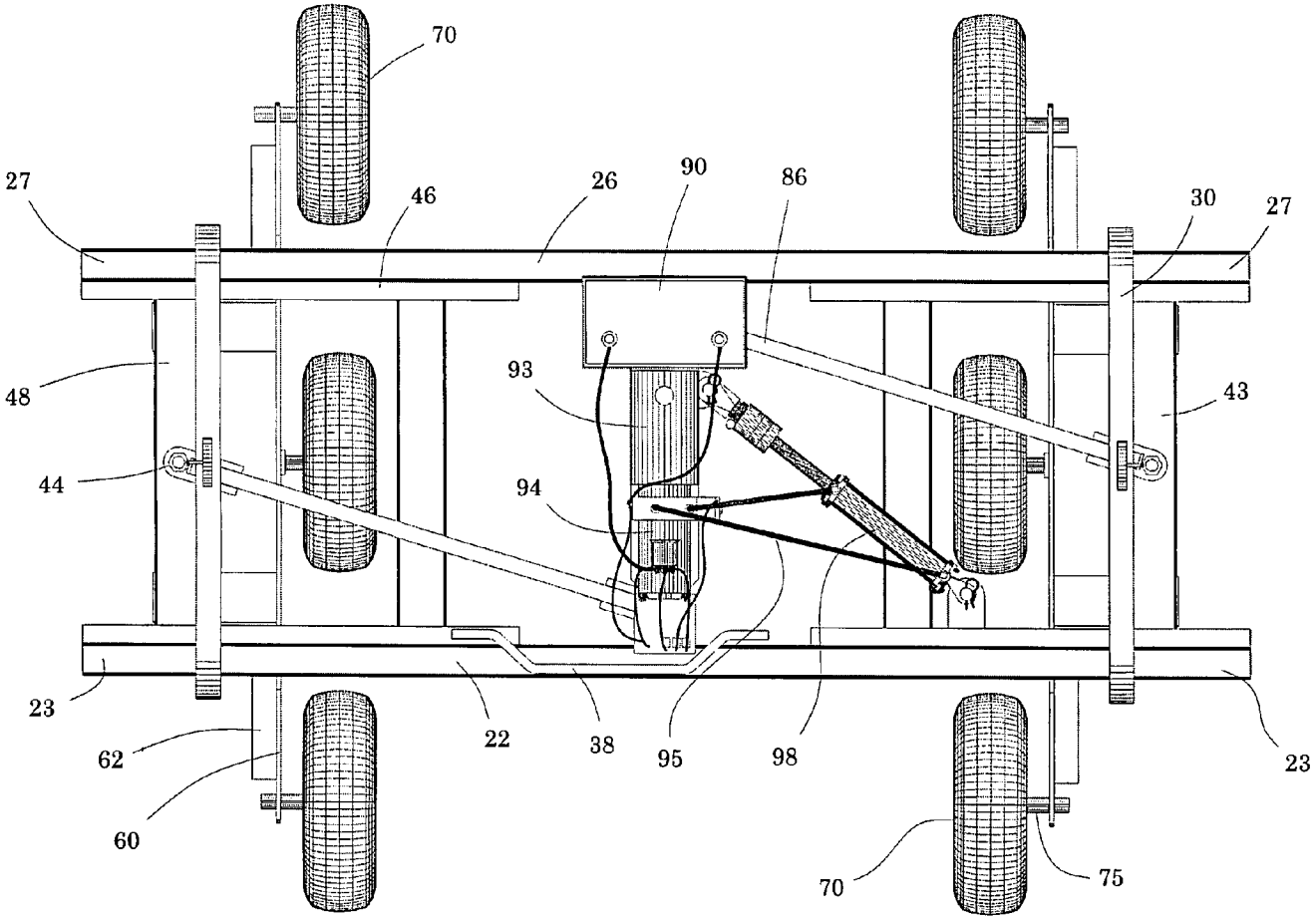
FIG. 3 is a top view of the ring lift device in the retracted position.
Figure 4:
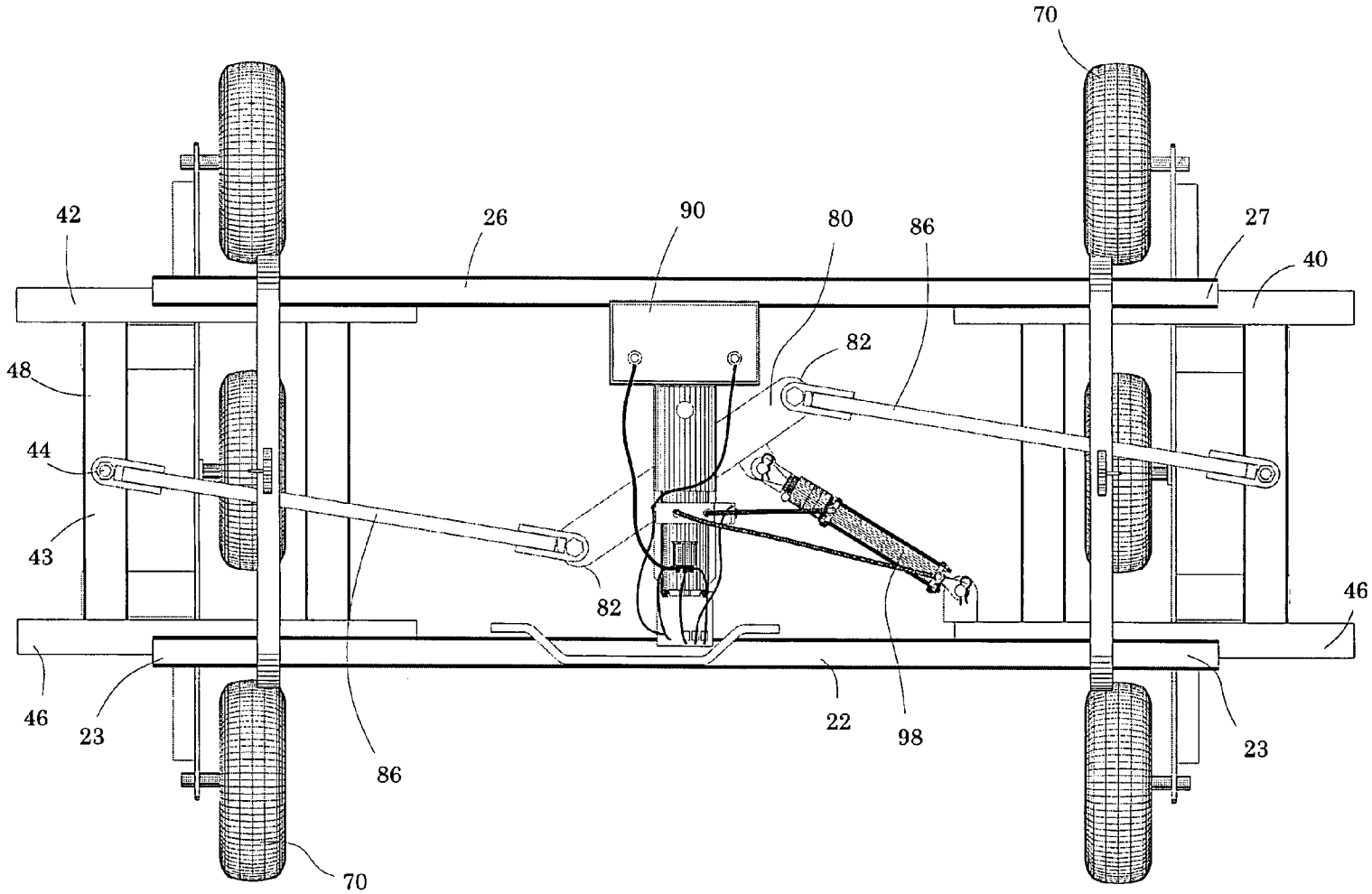
FIG. 4 is a top view of the ring lift device in the expanded position.
Figure 5:
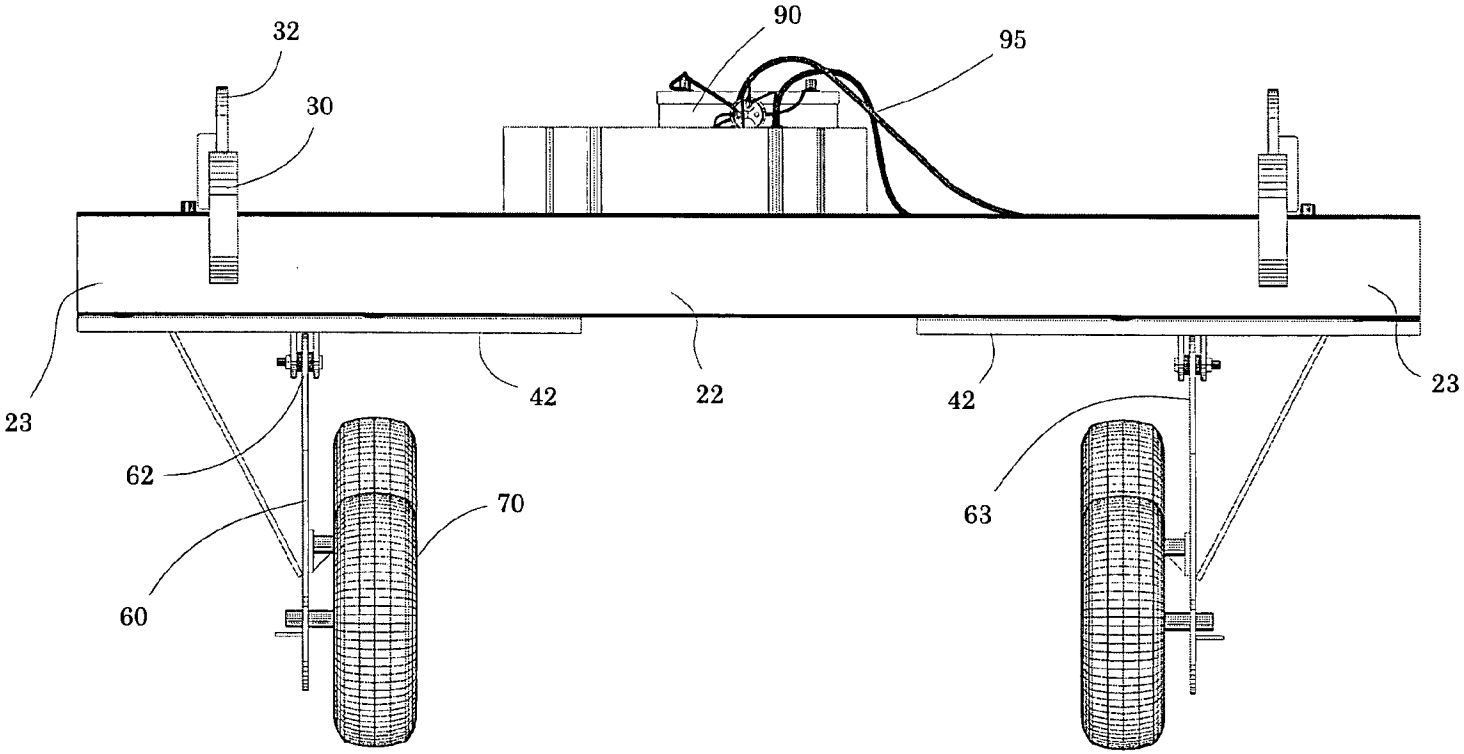
FIG. 5 is a front plan view of the ring lift device in the retracted position.
Figure 6:
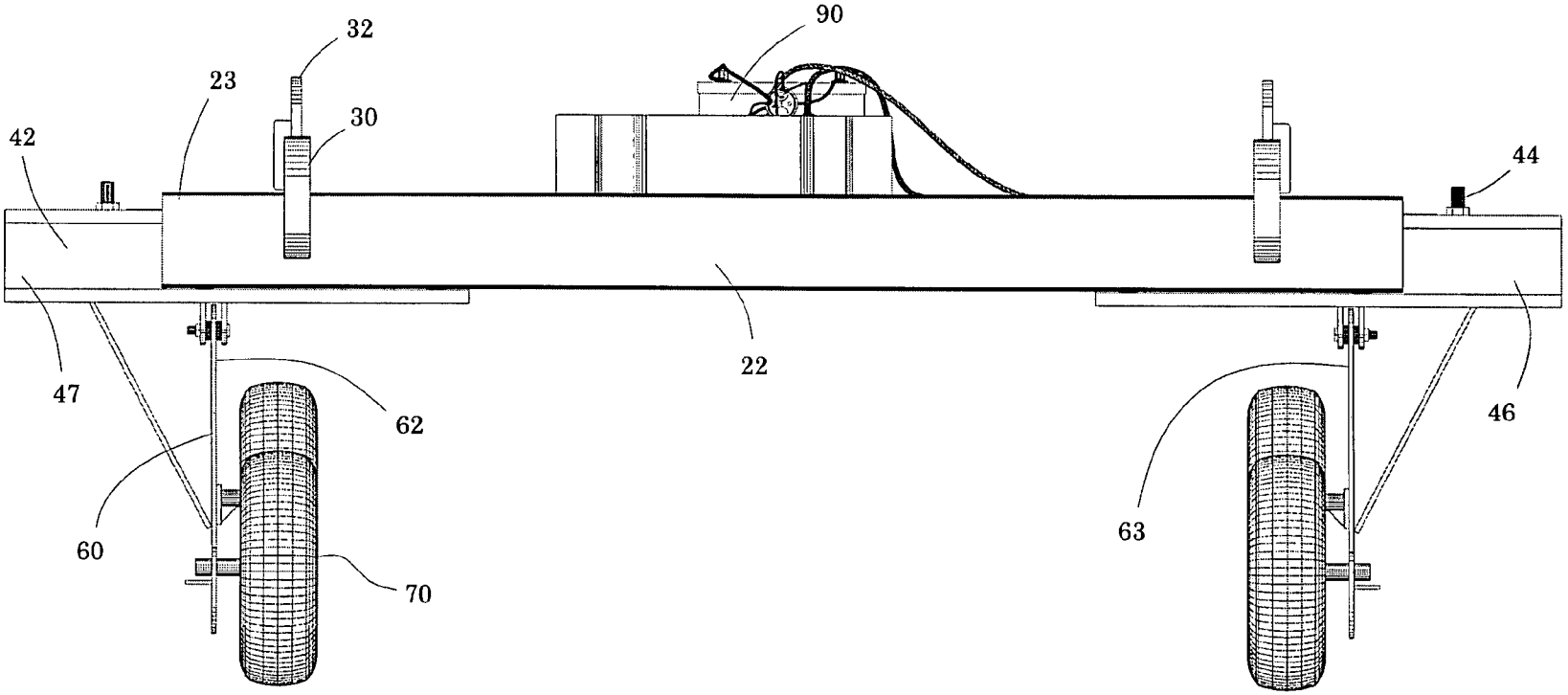
FIG. 6 is a front plan view of the ring lift device in the expanded position.
Figure 7:
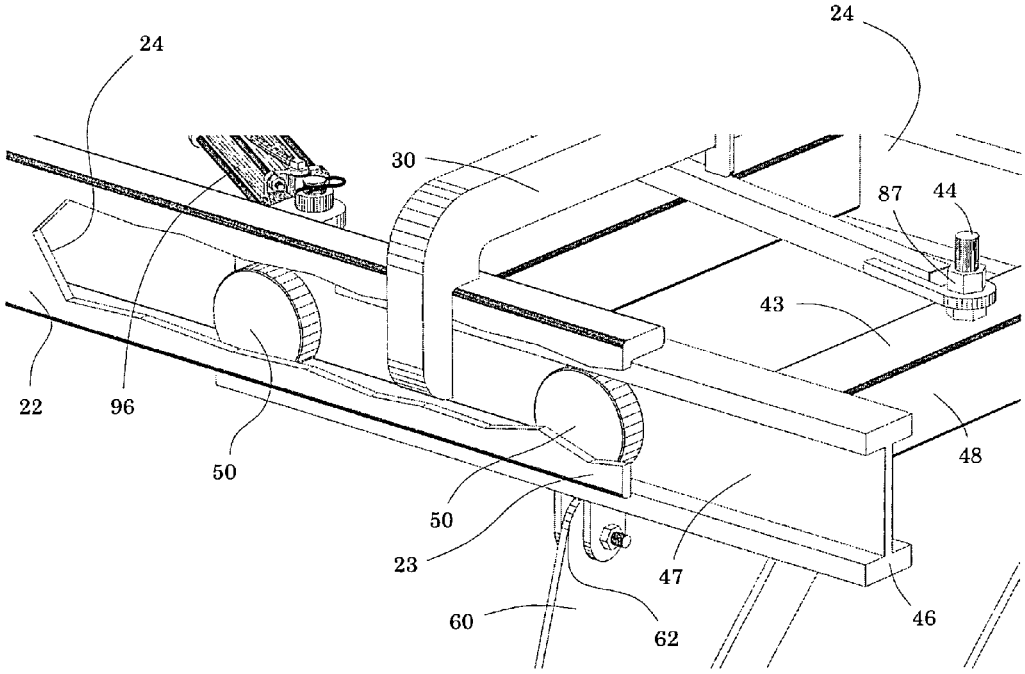
FIG. 7 is an isolated cutaway sectional view of the ring lift device indicating the movement relationship between each L-shaped member of the upper frame, the slide rollers and the C-channel of an upper slide member.

A ring lift device 10 for lifting a large hollow ring structures having a large inner diameter commonly fabricated during a manufacturing process utilized in manufacturing, transport and shipping, shown in FIGS. 1-7 of the drawings, the ring lift device 10 comprising an upper frame 20 defining a front inverted L-shaped member 22, a rear inverted L-shaped member 26, and two outer upper suspension supports 30 maintaining the front and rear inverted L-shaped members 22, 26, in parallel alignment and providing a suspension point 32 from which the upper frame 20 may be suspended from above, and a drive system platform 35 on top 37 of a central frame bar 36 supporting a portable battery power supply 90 and a hydraulic drive mechanism 92, a pair of lateral depending ring clamp structures 40 slidably engaging the front and rear L-shaped members 22, 26, which expand and contract from one another, each lateral depending ring clamp structure 40 providing an upper slide frame 42 defining a pair of support beams 46 containing an outer C-channel 47 attached by at least two support struts 48 maintaining the pair of support beams 46 in secure parallel alignment, each outer C-channel 47 engaging at least two inwardly directed slide rollers 50 rotatably attaching to an inner surface 24 of each parallel aligned inverted L-shaped member 22, 26, at a respective outer end 27, FIG. 7, and providing an independent sliding engagement between each lateral ring clamp structure 40 and the upper frame 20, each lateral depending ring clamp structure 40 further defining a lower vertical frame plate 60 defining an upper margin 62 attached to each respective upper slide frame 42, the lower vertical frame plate 60 also defining an inner flat surface 63 upon which a set of at least three broad inner grab wheels 70 are rotatably mounted, each set of grab wheels 70 directed towards one another and distributed in a symmetrically identical upwardly arced curvature with a central inner grab wheel 70*a* positioned above a first outer grab wheel 70*b* and a second outer grab wheel 70*c*, and a central pivot bar 80 and a pair of push rods 86, empowered by the hydraulic drive mechanism 92, expanding and contracting the two lateral depending ring clamp structures 40 away from and towards each other, the hydraulic drive mechanism 92 including a hydraulic piston arm 96 attached to the upper frame 20 near the central frame bar 36 and further attaching to the central pivotal bar 80, the central pivotal bar 80 being rotated around a central axis in a horizontal plane, the central pivotal bar 80 having uniformly spaced outer ends 82 pivotally attaching to each push rod 86, each push rod 86 further pivotally connected to a pivot attaching extension 44 on an upper surface 43 of each upper slide frame 42, expanding and retracting the upper slide frames 42 along the upper frame 20 expanding apart and then retracting the upper slide frames 42 to insert the facing inner grab wheels 70 within the inner diameter of each end of a subject ring structure wherein the ring structure can be elevated and moved without significant deformation to the ring structure.

It is important to the ring lift device 10 that it be balanced from front to rear and from side to side. In this regard, the ring lift device 10 may include certain counterweight components 38 to balance the overall ring lift device 10 to keep it level during use, FIG. 2, as it is generally intended for suspension from a lift mechanism suspended from over head in a manufacturing plant. The most practical application of the ring lift device 10 is for transfer movement and positioning of heavy fabricated metal rings used in the construction of a cylindrical vessel, although the device may be suitable for other uses due to its structural assembly and function.

As shown in FIGS. 1-4 of the drawings, the hydraulic drive mechanism 92 includes the battery power supply 90 within a secure battery carriage 91 on a top surface 21 of the upper frame 20, an electric drive motor 93 which is incorporated with a hydraulic pump 94, and the hydraulic piston arm 96 attached to the hydraulic pump 94 by hydraulic hoses 95. The hydraulic piston arm 96 may be provided with space limiters 98 to limit the expansion of the upper slide frames 42 along the upper frame 20. The limiters 98 would be included in situations where a number of same sized ring structures are being moved at one time, and the spacing of the upper slide frames 42 do not need to be over expanded or adjusted. It is preferred that the full extension of the hydraulic piston arm 96 would equate to the shortest distance or most retracted spacing between the upper slide frames 42, aligning the central pivot bar 80 perpendicular with the direction of the L-shaped members 22, 26, shown in FIGS. 1, 3 and 5, and full retraction of the hydraulic piston arm 96 would equate to the greatest distance or most expanded spacing between the upper slide frames 42, aligning the central pivot bar 80 in a direction diagonal with the L-shaped members 22, 26, FIGS. 4, 6 and 7. It is also contemplated within the scope of this ring lift device 10 that different length push rods 86 may be included with the ring lift device 10 selected in accordance with the width of the ring structures which are being handled. In this regard, the push rods 86 would be provided with a secure connection means 87 to the central pivot bar 80 and the upper slide frames 42 which are readily accessible and quickly connected and disconnected during push rod 86 exchange.

Viewing the ring lift device 10 in a cutaway sectional exposure, as shown in FIG. 7, the relationship between the paired slide rollers 50 and each outer C-channel 47 would be similar to a drawer slide, with the slide rollers 50 engaged securely within the respective C-channel 47 with nominal vertical play and on a horizontal plane when the ring lift device 10 is in suspension from overhead. The slide rollers 50 provide a smooth linear movement between each upper slide frame 42 and the upper frame 20 from the retracted and expanded positions as directed by the central pivot bar 80.

It is contemplated within the scope of the upper slide frame 42 that the central inner grab wheel 70*a* may be adjustable in a vertical direction, not shown, which would provide adjustment to the circumference of the arced curvature between the central inner grab wheel 70*a* and the front and rear grab wheels, 70*b*, 70*c*, resulting in the adaptation of the grab wheels 70 to specific diameter ring structures for optimal contact of the grab roller wheels 70 to the inner diameter of each ring structure. It is also contemplated that auxiliary outriggers may be attached to each lower vertical frame plate 60, not shown, which provide extended grab wheels beyond the first and second grab wheels 70*b*, 70*c*, the outriggers attaching for the movement of an oversized ring structure or an elongated curved panel which has been formed and requires movement without distortion or bending. In this embodiment, there may be a braking means applied to each or at least one grab wheel 70 to prevent rotation of the at least one grab wheel 70 during a transport operation. As shown in the drawings, the preferred embodiment of the grab wheel 70 would be a conventional vehicle wheel 72 with a pneumatic tire 74 attaching to each lower vertical frame plate 60 by a respective independent axle 75. It is also contemplated that numerous support structures may be included within the scope of the referenced components and assembly which are not numbered or included in the claims, but would be utilized by those skilled in the art in the construction and assembly structures that provide stability, balance and integrity to the ring lift device 10, including bracing, brackets, anchors, washers. While the ring lift device 10 has been particularly shown and described with reference to a preferred embodiment thereof, it will be understood by those skilled in the art that changes in form and detail may be made therein without departing from the spirit and scope of the invention.

What is claimed is:

1. A ring lift device for lifting and moving large hollow ring structures having large inner diameters and handled during manufacturing, transport and shipping of said ring structures, said ring lift device comprising:

an upper frame defining a front inverted L-shaped member, a rear inverted L-shaped member, and two outer upper suspension supports maintaining said front and rear inverted L-shaped members in parallel alignment and providing a suspension point from which said upper frame is suspended from overhead, and a drive system platform on a top of a central frame bar supporting a portable battery power supply and a hydraulic drive mechanism;

a pair of lateral depending ring clamp structures slidably engaging said front and rear L-shaped members, which expand and contract from one another, each lateral depending ring clamp structure defining an upper slide frame including a pair of support beams containing an outer C-channel attached by at least two support struts maintaining said pair of support beams in secure parallel alignment, each outer C-channel engaging at least two inwardly directed slide rollers rotatably attaching to an inner surface of each parallel aligned inverted L-shaped member at a respective outer end and further providing an independent sliding engagement between each lateral ring clamp structure and said upper frame;

a lower vertical frame plate defining an upper margin attached to each respective upper slide frame and an inner flat surface upon which a set of at least three broad inner grab wheels are rotatably mounted, each set of grab wheels directed towards one another and distributed in a symmetrically identical upwardly arced curvature; and a central pivot bar and a pair of push rods, empowered by said hydraulic drive mechanism, expanding and contracting said two lateral depending ring clamp structures away from and towards each other, by the central pivot bar rotated around a central axis in a horizontal plane, said central pivot bar having uniformly spaced outer ends pivotally attaching to each push rod expanding and retracting said upper slide frames along said upper frame to insert said facing inner grab wheels within said inner diameter of each end of a ring structure wherein said ring structure can be elevated and moved without significant deformation to said subject ring structure.

2. The ring lift device as disclosed in claim 1, said hydraulic drive mechanism further defining a hydraulic piston arm attached to said upper frame near said central frame bar and further attaching to said central pivot bar to rotate said central pivot bar; and said battery power supply within a secure battery carriage on a top surface of the upper frame, an electric drive motor incorporating a hydraulic pump, said hydraulic piston arm connecting said hydraulic pump by hydraulic hoses.

3. The ring lift device as disclosed in claim 1, said hydraulic drive mechanism further defining a hydraulic piston arm attached to said upper frame near said central frame bar and further attaching to said central pivot bar to rotate said central pivot bar with said hydraulic piston arm providing space limiters to limit expansion of said upper slide frames along said upper frame where repeated expansion and contraction of said upper slide frames for moving objects of uniform shape and size.

4. The ring lift device as disclosed in claim 1 said hydraulic drive mechanism further defining a hydraulic piston arm attached to said upper frame near said central frame bar and further attaching said central pivot bar to rotate said central pivot bar, wherein full extension of said hydraulic piston arm equates to a shortest distance and most retracted spacing between said upper slide frames, aligning said central pivot bar perpendicular with said L-shaped members and full retraction of said hydraulic piston arm equates to a greatest distance and most expanded spacing between said upper slide frames, aligning said central pivot bar diagonal to said L-shaped members.

5. The ring lift device as disclosed in claim 1, said pair of push rods supplied in more that one length with an appropriate pair of said push rods selected in accordance with the width of the ring structures which are being handled, each said push rod connecting by a secure connection means to said central pivot bar and said upper slide frame, said secure connecting means readily accessible and quickly connected and disconnected during said pair of push rods being exchanged.

6. The ring lift device as disclosed in claim 1, each said set of broad inner grab wheels further comprising a central inner grab wheel positioned above a first outer grab wheel and a second outer grab wheel.

7. The ring lift device as disclosed in claim 1, each grab wheel of said set of broad inner grab wheels is a conventional vehicle wheel with a pneumatic tire attaching to each said respective lower vertical frame plate by a respective independent axle.

* * * * *